US008312597B2

(12) United States Patent
Gallasch et al.

(10) Patent No.: US 8,312,597 B2
(45) Date of Patent: Nov. 20, 2012

(54) HINGE CUP FOR FURNITURE HINGES

(75) Inventors: Steffen Gallasch, Reinheim-Spachbrüeken (DE); Karlheinz Sättler, Fränlisch-Crumbach (DE)

(73) Assignee: Grass GmbH & Co. KG, Reinheim (DE)

( * ) Notice: Subject to any disclaimer, the term of this patent is extended or adjusted under 35 U.S.C. 154(b) by 0 days.

(21) Appl. No.: 12/955,114

(22) Filed: Nov. 29, 2010

(65) Prior Publication Data

US 2011/0099762 A1 May 5, 2011

Related U.S. Application Data

(63) Continuation of application No. PCT/EP2009/003765, filed on May 27, 2009.

(30) Foreign Application Priority Data

May 31, 2008 (DE) ..... 20 2008 007 345 U

(51) Int. Cl.
*E05D 5/00* (2006.01)

(52) U.S. Cl. ..... 16/383; 16/388

(58) Field of Classification Search ..... 16/382–384, 16/370, 388, 261, DIG. 40, DIG. 43, 272, 16/258; 403/119, 231

See application file for complete search history.

(56) References Cited

U.S. PATENT DOCUMENTS

| | | | | |
|---|---|---|---|---|
| 5,463,796 | A * | 11/1995 | Brustle et al. | 16/383 |
| 6,073,311 | A | 6/2000 | Lautenschläger | |
| RE37,236 | E * | 6/2001 | Brustle et al. | 16/383 |
| 6,286,186 | B1 | 9/2001 | Lautenschläger et al. | |

FOREIGN PATENT DOCUMENTS

| | | | |
|---|---|---|---|
| DE | 44 14 460 | C2 | 12/2001 |
| DE | 195 21 909 | C2 | 12/2003 |
| DE | 195 17 924 | B4 | 3/2006 |
| EP | 0 610 765 | B1 | 4/1996 |
| EP | 905341 | A1 * | 3/1999 |
| EP | 0 905 341 | B1 | 3/2002 |

* cited by examiner

*Primary Examiner* — Victor Batson
*Assistant Examiner* — Matthew Sullivan
(74) *Attorney, Agent, or Firm* — Burr & Brown

(57) ABSTRACT

A hinge cup for furniture hinges having a cup part which can be mounted in a bore in a furniture part such that it can be inserted in a recessed manner, and having, provided on the cup part in the state mounted in the bore, anchoring parts which can be spread open and have external bearing surfaces which are curved arcuately in a manner substantially corresponding to the radius of the bore and can be pressed via tension elements against the wall of the bore, wherein the tension elements can be moved via an eccentric mechanism in the insertion direction of the hinge cup at right angles to the mounting plane of the latter, and the anchoring parts are spread when the tension elements are moved in the direction from the insertion end of the hinge cup to the mounting surface thereof.

5 Claims, 2 Drawing Sheets

Fig. 1
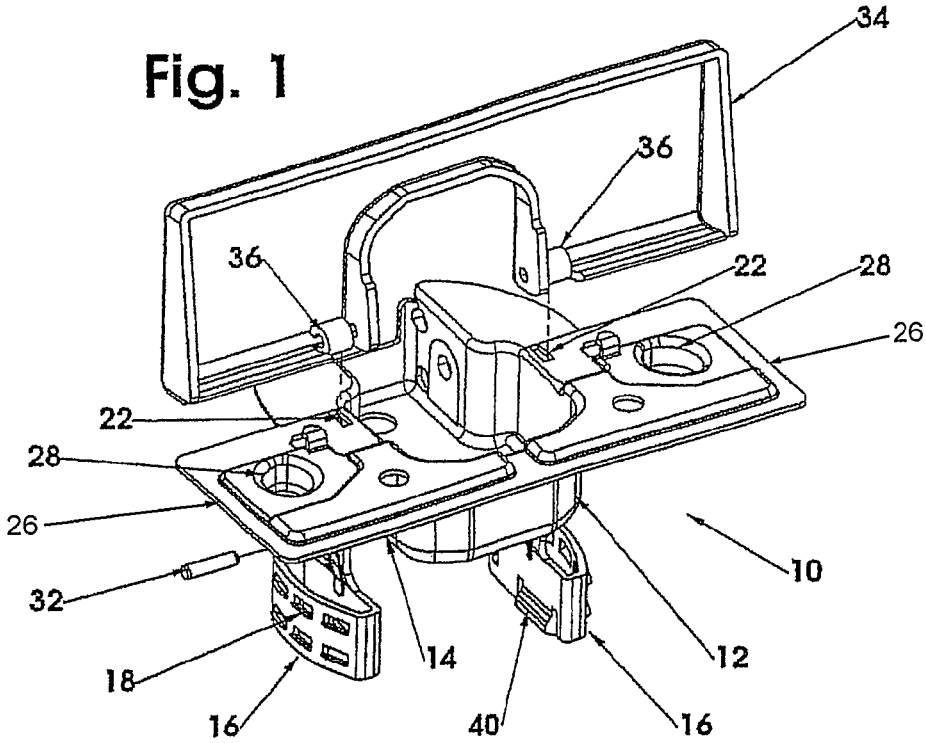
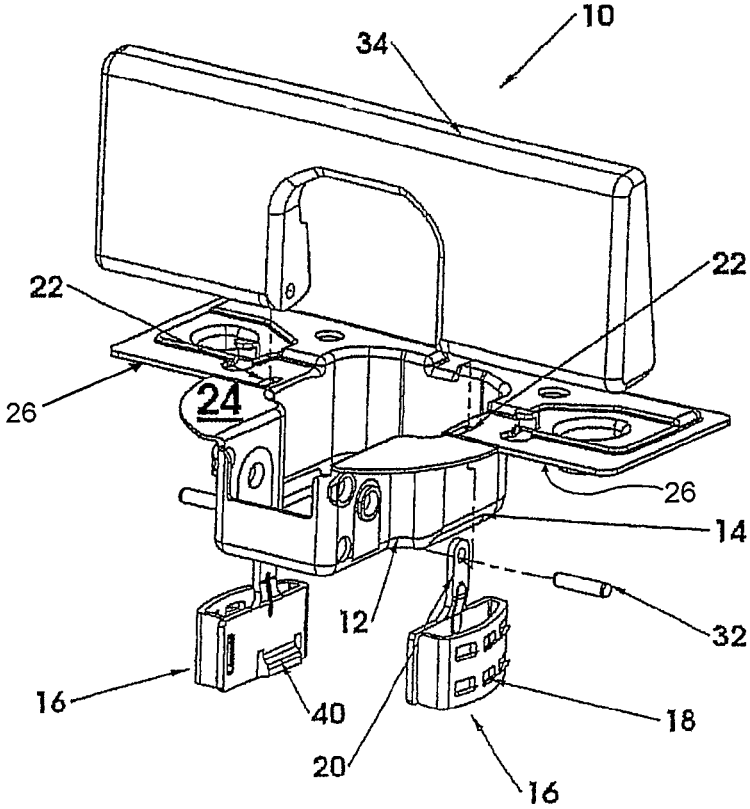
Fig. 2

Fig. 3
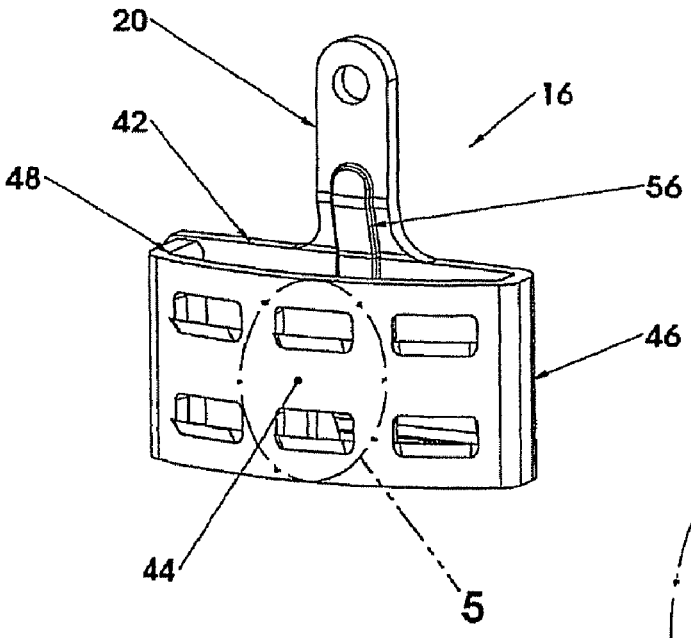
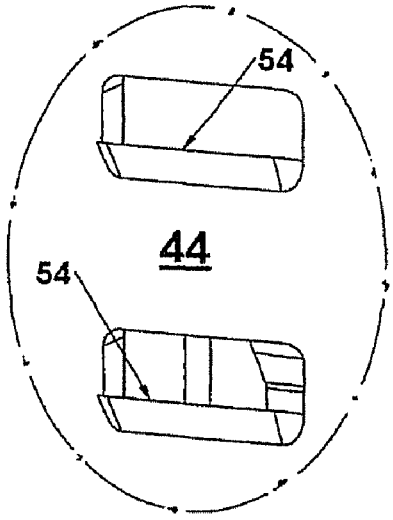
Fig. 5
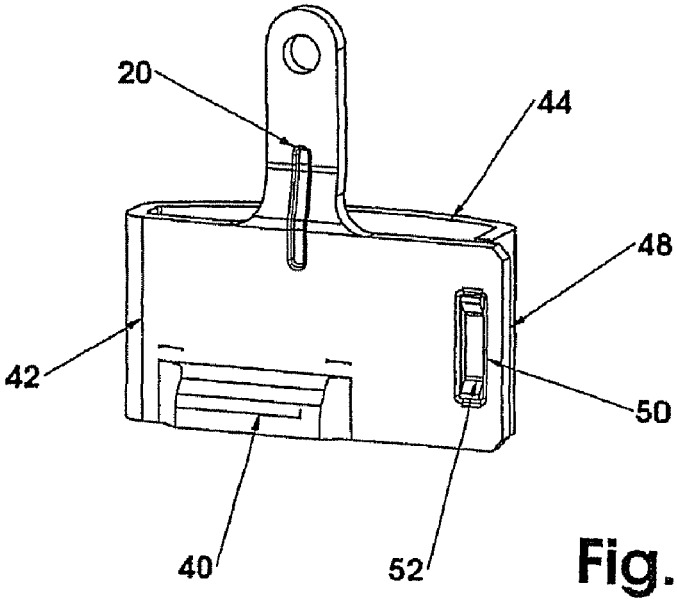
Fig. 4

HINGE CUP FOR FURNITURE HINGES

CROSS REFERENCE TO RELATED APPLICATIONS

This application is a continuation of International Application No. PCT/EP2009/003765 filed May 27, 2009, which designated the United States, and claims the benefit under 35 USC §119(a)-(d) of German Application No. 20 2008 007 345.6 filed May 31, 2008, the entireties of which are incorporated herein by reference.

FIELD OF THE INVENTION

The invention relates to a hinge cup for furniture hinges, having a cup part which can be mounted in a bore in a furniture part such that it can be inserted in a recessed manner, and having, provided on the cup part in the state mounted in the bore, anchoring parts which can be spread open and have external bearing surfaces which are curved arcuately in a manner substantially corresponding to the radius of the bore and can be pressed via tension elements against the wall of the bore, wherein the tension elements can be moved via an eccentric mechanism in the insertion direction of the hinge cup at right angles to the mounting plane of the latter, and the anchoring parts are spread when the tension elements are moved in the direction from the insertion end of the hinge cup to the mounting surface thereof.

BACKGROUND OF THE INVENTION

The mounting of furniture fittings without tools has the advantage, compared to the fastening of the fitting parts with screws, of simpler and quicker mounting and demounting. Fastening possibilities for hinge cups of furniture hinges have already been created, wherein the hinge cup in the assigned bore in the furniture part was produced by clamping by means of anchoring parts arranged between the outside of the hinge cup and the circumferential wall of the bore (DE 19521909; EP 0905341B1; DE 20006514U1) or by anchoring elements which can be mounted in separate fastening bores in the furniture part (DE 19517924 B4; DE 4414460 C2), these fastening possibilities having, besides simpler and quicker mounting compared with screw fastening, the advantage of increased durability and anchoring strength.

When mounting hinge cups in furniture parts made of the nowadays increasingly used particle-board materials, one problem is that the holding or clamping force generated in the mounted state between the wall of the bore in the furniture part and the cup part of the hinge cup is transmitted in a manner distributed over as wide an area as possible in order to ensure that the material in the wall region of the fastening bore is not damaged, even in the event of repeated mounting and demounting. In the case of a known hinge cup (EP 0 610 765), separate clamping jaws in the form of cylinder segments made of viscoelastic material, such as plastic or rubber, were therefore arranged in between in the pressing region of the anchoring parts. Rubber and/or comparable elastic plastic materials are, however, prone to time-dependent changes in their elastic material properties, e.g. becoming brittle or hard, as a result of which the stress-absorbing capability of the mount for such a hinge cup in an associated fastening bore also changes.

SUMMARY OF THE INVENTION

In contrast, the object of the invention is to create a hinge cup for mounting and demounting, without tools, in the associated bore in the furniture part, permanently ensuring, besides simple and quick mounting, gentle transmission, preserving the material of the furniture part from damage, of the clamping forces between the hinge cup and the furniture part.

Proceeding from a hinge cup of the type mentioned at the beginning, this object is achieved according to the invention in that the tension elements and the anchoring parts are formed as integral metal components punched out of originally planar metal strip material and subsequently formed by press working, and in that the external regions of the anchoring parts, which can be pressed in a clamping manner against the wall of the bore in the furniture part during the spreading process, are formed as deformable pressing wall portions which are resilient in the radial direction and are delimited in a substantially arcuate manner in plan view. By producing the anchoring parts as integral metal components, it is no longer necessary, in the production of the hinge cup, to premount separate clamping jaws on the anchoring parts, wherein the resilient formation of the regions, which can be pressed in a clamping manner against the wall of the bore in the furniture part, of the anchoring parts as resiliently deformable metal wall portions ensures that the clamping force, exerted via the eccentric mechanism during the fastening of the hinge cup in the bore in the furniture part, is stored as spring prestressing in the deformed pressing wall portion of the anchoring parts and thus the clamping force retaining the hinge cup in the bore is maintained even over relatively long periods of use.

In an advantageous development of the invention, it is recommended that the anchoring parts have in each case a supporting wall portion, which is formed in a manner substantially corresponding to the laterally flattened regions of the cup part and can be applied to the flattened regions, and to which the respective tension element is attached, and that the arcuately delimited pressing wall portion, which can be pressed against the wall of the bore in the furniture part, is attached integrally to the supporting wall portion and is bent about a bending portion of the supporting wall portion, the bending portion extending in the insertion direction of the hinge cup.

In this case it can be expedient if the pressing wall portion, which can be pressed against the wall of the bore in the furniture part, has, in its free end region opposite the bending portion, at least one narrow, strip-like end portion which is bent toward the supporting wall portion and the free delimiting edge of which, facing the supporting wall portion, extends parallel to and spaced apart from the facing surface of the supporting wall portion in the insertion direction. The intermediate space between the supporting wall portion and the free delimiting edge of the pressing wall portion thus delimits the possible elastic deformation travel of the pressing wall portion.

At the free delimiting edge of the end portion, there is then expediently provided a projection which is preferably elongate in cross section and engages in a recess, which is formed in a complementary manner, in the supporting portion, thereby preventing inadmissible displacement of the pressing wall portion relative to the supporting wall portion in the case of forces acting on the hinge cup in the withdrawing direction.

The surfaces, facing the circumferential wall of the bore in the furniture part, of the pressing wall portions of the anchoring parts are expediently provided with protruding anchoring projections, which, when the anchoring parts bear in a clamping manner against the wall of the bore, additionally penetrate in a form-fitting manner into the material of the wall of the bore by actuating the eccentric portion and thus bring about, besides the force-fitting retention, a certain additional form-fitting connection of the anchoring parts in the wall of the bore.

In an advantageous development of the invention, the anchoring projections are prestamped radially toward the outside from the material of the pressing wall portion, wherein the configuration can, for example, be made such that the anchoring projections are cut out along a delimiting edge extending in the circumferential direction of the pressing wall portions and the cut-out delimiting edge is prestamped via the flat side of the pressing wall portions, the flat side facing the wall of the bore, forming in this case cutting edges which extend in the circumferential direction and promote penetration into the material of the wall of the bore, i.e. additional form-fitting of the hinge cup without damaging adjoining wall regions of the bore.

The spreading of the anchoring parts during the mounting process of the hinge cup in the associated bore via the eccentric mechanism can be ensured in that the supporting wall portion of the anchoring parts is provided in the regions at the front in the insertion direction with in each case at least one tensioning cam, which protrudes, rising in the manner of a ramp in the insertion direction, integrally from the material of the supporting wall portion in the direction of the cup part, the tensioning cams being pulled, during the spreading of the anchoring parts, out of a position lying underneath the flattened regions of the cup part, via the rounded transition region of the base thereof, into the flattened regions of the cup part circumferential wall, and thereby radially spreading open the anchoring parts.

BRIEF DESCRIPTION OF THE DRAWINGS

The invention is explained in more detail in the following description of an exemplary embodiment in conjunction with the drawing, in which:

FIGS. 1 and 2 show in each case isometric illustrations of a hinge cup according to the invention from different viewing directions, wherein the anchoring parts provided for fastening by clamping in an associated fastening bore in the door leaf of a cupboard are illustrated in a state in which they are not yet connected to the eccentric mechanism, i.e. separate from the actual hinge cup and offset slightly downward;

FIGS. 3 and 4 show in each case isometric views of one of the anchoring parts of the hinge cup shown in FIGS. 1 and 2 in viewing directions toward the front and rear sides of the anchoring part; and FIG. 5 shows the portion, lying within the portion 5 delimited by the dot-dash oval line in FIG. 3, of the pressing wall portion of the anchoring part, on a larger scale than in FIG. 3.

DETAILED DESCRIPTION OF THE INVENTION

The exemplary embodiment shown in FIGS. 1 and 2 of a hinge cup which is formed in the manner according to the invention and designated as a whole by 10 is part of an otherwise conventional furniture hinge which can serve for pivotably hinging a door leaf on the body of a cupboard.

Since such hinges are known in their basic configuration, for example in the form of four-bar hinges, only the hinge cup modified according to the invention will be described hereinbelow.

The hinge cup has a cup part 12, which can be inserted in a recessed manner in a fastening bore provided close to the edge of the rear side of a door leaf, and has, in two opposite regions of its circumferential wall, wall regions 14 which are laterally flattened compared with the fastening bore delimited in the form of a circle in plan view and at which there are provided anchoring parts 16, which have arcuately curved external bearing surfaces 18, corresponding substantially to the radius of the fastening bore, and can be displaced in the intermediate space between the flattened wall regions 14 of the cup part 12 and the circumferential wall of the bore into the associated fastening bore via integrally attached tension elements 20 in the insertion direction of the cup part of the hinge. The tension elements 20 integrally attached to the upper delimiting edge of the anchoring parts 16 are guided through slot-like openings 22 in a covering flange 24 which is attached to the upper edge of the cup part 12 and delimited in a circularly arcuate manner in portions. The covering flanges 24, which are provided for covering between the laterally flattened regions of the cup part 12 and the circumferential wall, which is delimited in a circular manner, of the fastening bore are enlarged in their rear region to form a fastening flange 26 projecting on both sides beyond the covering flange 24 and resting on the rear side of the door leaf in the intended mounting position on the door leaf. Provided in opposing outer regions of the fastening flange are punched-out portions 28, which are delimited in a circular manner and can be seen in FIG. 1, and the edges of which, which are delimited in a circularly arcuate manner and protrude from the underside of the fastening flange, can serve to engage in centering bores, provided in addition to and next to the fastening bore, in the door leaf, in order to ensure that the hinge cup 10 can be mounted only in the correct alignment with respect to the door leaf.

Alternatively, the punched-out portions can also serve to fasten centering pins which can additionally be attached to the fastening flange 26.

The upper ends, which pass through slot-like openings 22, of the tension elements 20 are joined by means of bolts 32 to the underside of a cover 34, which is mounted pivotably on the top of the hinge cup 10 and conceals the fastening flange 26 in the pivoted-down position, and which is supported on the top of the fastening flange via eccentric cams 36 which are spaced apart from one another. When the cover 34 is pivoted down from the position shown in FIGS. 1 and 2 into the position covering the fastening flange, the eccentric cams 36 push the cover slightly away from the fastening flange 26, as a result of which the anchoring parts 16 are pulled up via the tension elements 20 counter to the insertion direction of the cup part. In this case, ramp-like tensioning cams 40 provided on the rear side, facing the flattened regions of the cup part, of the anchoring parts 16 then come into abutment against the rounded transition region from the base into the circumferential wall of the cup part and are then pulled up via this transition region, as a result of which the anchoring parts are spread open radially outward and the hinge cup is clamped in the fastening bore.

This clamping can be released again by pivoting up the cover 34 at the pivoted-down position, during which the tension elements 20 are pushed back in the insertion direction. The use of tools for the mounting or demounting of the hinge cup is thus not necessary. To this extent, the hinge cup 10 described here has a similar configuration and function to older known hinge cups.

Novel and advantageous is, however, the configuration, described below in conjunction with FIGS. 3 to 5, of the anchoring parts 16. These anchoring parts—including the tension elements 20—are integral metal components, which are punched out integrally from originally planar metal strip material, are subsequently formed by further pressing and bending processing steps and are produced with the required strength by the original material used such that, on the one hand, high mechanical stresses in the material, which occur during the mounting of the hinge part 10, can be absorbed, wherein the stress occurring between the outer surface of the respective anchoring part 16 and the assigned portion of the wall of the fastening bore in the furniture part can be stopped by the possible resilient bending of the anchoring part 16 in the pressing region in a given order of magnitude, at which the structure of the wall of the bore in the furniture part is not destroyed.

The anchoring parts 16 have, as can be gathered from FIGS. 3 and 4, in each case a supporting wall portion 42, which is correspondingly formed substantially in the laterally flattened regions 14 of the cup part 12, is largely planar and delimited at right angles and to the upper edge of which the lug-like tension element 20 is integrally attached. Integrally attached to the vertical edge, on the right in FIG. 3, of the supporting wall portion 42 is the arcuately delimited pressing wall portion 44, which can be pressed against the wall of the fastening bore in the furniture part. This integral connection with the supporting wall portion 42 takes place via a narrow connecting portion 46, which connects the originally planar blank of supporting and pressing wall portions as a bending region. The pressing wall portion 44 for its part is arcuately curved in a manner corresponding to the radius of the associated bore in the furniture part.

In the opposite free vertical end region, the pressing wall portion 44 has a narrow, strip-like end portion 48, which is bent toward the supporting wall portion 42 and the free delimiting edge of which, facing the supporting wall portion 42, extends parallel to and spaced apart from the facing surface of the supporting wall portion 42 in the insertion direction of the hinge cup into the bore. Within the gap formed between the end face of the end portion 48 and the supporting wall portion 42, the pressing wall portion 44 can thus be bent resiliently in the direction of the supporting wall portion 42.

At the free delimiting edge of the end portion 48, there is furthermore provided a projection 50 which is elongated in cross section and engages in a recess 52, which is formed in a complementary manner, in the supporting wall portion.

The surface, facing the circumferential wall of the bore in the furniture part, of the respective pressing wall portion 44 is—in the exemplary embodiment shown—provided in total with two rows of in each case three anchoring projections 54. These anchoring projections 54 are, as can be seen in particular in FIG. 5, formed in that elongate wall regions are cut out of the material of the pressing wall portion 44 and are bent radially obliquely outward. The outwardly directed free delimiting edge of the anchoring projections 54 thus forms a cutting edge, which can penetrate into the surrounding wall of the fastening bore in the furniture part during the mounting process of the hinge cup 10.

In FIG. 4 it can also be seen that the tensioning cam 40, which has already been described in the description of the hinge cup 10 in conjunction with FIGS. 1 and 2 and rises in the manner of a ramp, is stamped out of the material of the pressing wall portion 42 in the direction of the assigned flattened portion 14 of the cup part 12.

It can further be seen in FIGS. 3 and 4 that, in the transition region of the lug-like tension element 20 into the pressing wall portion 42, a reinforcing bead 56 is impressed on this transition region and provides reinforcement against elastic or permanent deformation.

The invention claimed is:

1. A hinge cup for furniture hinges, the hinge cup comprising:

a cup part which can be mounted in a bore in a furniture part in a recessed manner, the cup part having anchoring parts on a mounting surface thereof that spread open and have external hearing surfaces which are curved arcuately in a manner substantially corresponding to a radius of the bore and are pressed via tension elements against a wall of the bore, wherein the tension elements are moved via an eccentric mechanism in an insertion direction of the hinge cup at right angles to a mounting plane of the hinge cup, and wherein the anchoring parts spread as the tension elements move in a direction from an insertion end of the hinge cup to the mounting surface thereof, wherein the tension elements and the anchoring parts are integral metal components punched out of an originally planar metal strip material and subsequently formed by press working; and wherein external regions of the anchoring parts, which are pressed in a clamping manner against the wall of the bore in the furniture part during the spreading process, are formed as deformable pressing wall portions that are resilient in a radial direction and are delimited in a substantially arcuate manner in a plan view, wherein each of the anchoring parts comprises a supporting wall portion, which is formed in a manner substantially corresponding to a laterally flattened region of the cup part and is applied to the flattened region, the tension element which is attached thereto, and the arcuately delimited pressing wall portion, which is pressed against the wall of the bore in the furniture part, is attached integrally to the supporting wall portion and is bent about a bending portion of the supporting wall portion, said bending portion extending in the insertion direction of the hinge cup, wherein the pressing wall portion, which is pressed against the wall of the bore in the furniture part further comprises a free end region opposite the bending portion, and at least one narrow, strip-like end portion which is bent toward the supporting wall portion, wherein a free delimiting edge of the strip-like end portion facing the supporting wall portion, extends parallel to and spaced apart from a facing surface of the supporting wall portion in the insertion direction, and wherein, at a free delimiting edge of the strip-like end portion, there is provided a projection which is elongated in cross section and engages in a recess formed in the supporting wall portion.

2. The hinge cup as claimed in claim 1, wherein surfaces of the pressing wall portions facing the wall of the bore in the furniture part are provided with protruding anchoring projections.

3. A hinge cup for furniture hinges, the hinge cup comprising:

a cup part which can be mounted in a bore in a furniture part in a recessed manner, the cup part having anchoring was on a mounting surface thereof that spread open and have external bearing surfaces which are curved arcuately in a manner substantially corresponding to a radius of the bore and are pressed via tension elements against a wall of the bore, wherein the tension elements are moved via an eccentric mechanism in an insertion direction of the hinge cup at right angles to a mounting plane of the hinge cup, and wherein the anchoring parts spread as the tension elements move in a direction from an insertion end of the hinge cup to the mounting surface thereof, wherein the tension elements and the anchoring parts are integral metal components punched out of an originally planar metal strip material and subsequently formed by press working; and wherein external regions of the anchoring parts, which, are pressed in a clamping manner against the wall of the bore in the furniture part during the spreading process, are formed as deformable pressing wall portions that are resilient in a radial direction and are delimited in a substantially arcuate manner in a plan view, wherein each of the anchoring parts comprises a supporting wall portion, which is formed in a manner substantially corresponding to a laterally flattened region of the cup part and is applied to the flattened region, the tension element which is attached thereto, and the arcuately delimited pressing wall portion, which is pressed against the wall of the bore in the furniture part, is attached integrally to the supporting wall portion and is bent about a bending portion of the supporting wall portion, said bending portion extending in the insertion direction of the hinge cup, wherein the pressing wall portion, which is pressed against the wall of the bore in the furniture part further comprises a free end region opposite the bending portion, and at least one narrow, strip-like end portion which is bent toward the supporting wall portion, wherein a free delimiting edge of the strip-like end portion facing the supporting wall portion, extends parallel to and spaced apart from a facing surface of the supporting wall portion in the insertion direction, wherein, at a free delimiting edge of the strip-like end portion, there is provided a projection which is elongated in cross section and engages in a recess formed in the supporting wall portion, and wherein the anchoring projections are prestamped from the material of the pressing wall portion.

4. The hinge cup as claimed in claim 2, wherein the anchoring projections are cut out along a delimiting edge extending in the circumferential direction of the pressing wall portions and the cut-out delimiting edges are prestamped via the flat side of the pressing wall portions, said flat side facing the wall of the bore.

5. The hinge cup as claimed in claim 1, wherein the supporting wall portion of each of the anchoring parts further comprises at least one tensioning cam in a region at the front in the insertion direction, which protrudes, rising in the manner of a ramp in the insertion direction, integrally from the material of the supporting wall portion in the direction of the cup part, said at least one tensioning cam being pulled, during the spreading of the anchoring part, out of a position lying underneath the laterally flattened region of the cup part, via a rounded transition region of the base thereof, into the laterally flattened region of the cup part circumferential wall.

* * * * *

UNITED STATES PATENT AND TRADEMARK OFFICE

CERTIFICATE OF CORRECTION

PATENT NO. : 8,312,597 B2
APPLICATION NO. : 12/955114
DATED : November 20, 2012
INVENTOR(S) : Steffen Gallasch et al.

It is certified that error appears in the above-identified patent and that said Letters Patent is hereby corrected as shown below:

Column 6, Line 2

(claim 1, line 6): please change “hearing” to --bearing--.

Column 6, Line 53

(claim 3, line 4): please change “was” to --parts--.

Column 7, Line 1

(claim 3, line 19): please change “which,” to --which--.

Signed and Sealed this
Fifth Day of February, 2013

Teresa Stanek Rea
*Acting Director of the United States Patent and Trademark Office*